US005735261A

United States Patent [19]

Kieslinger

[11] Patent Number: 5,735,261

[45] Date of Patent: Apr. 7, 1998

[54] OVEN DOOR OF A KITCHEN STOVE

[75] Inventor: Michael Kieslinger, Freising, Germany

[73] Assignee: Bosch-Siemens Hausgeraete GmbH, Munich, Germany

[21] Appl. No.: 523,264

[22] Filed: Sep. 5, 1995

[30] Foreign Application Priority Data

Sep. 5, 1994 [DE] Germany ..... 44 31 619.4

[51] Int. Cl.[6] ..... F23M 9/00

[52] U.S. Cl. ..... 126/190; 126/194; 126/198; 126/200

[58] Field of Search ..... 126/190, 198, 126/194, 200

[56] References Cited

U.S. PATENT DOCUMENTS

| | | | |
|---|---|---|---|
| 3,339,541 | 9/1967 | Evans | 126/200 |
| 4,253,286 | 3/1981 | Katona | 126/200 X |
| 4,390,767 | 6/1983 | Bucksbaum et al. | 126/200 X |
| 5,441,036 | 8/1995 | Mikalauskas, II et al. | 126/200 X |
| 5,441,226 | 8/1995 | Craven, Jr. et al. | 126/200 X |
| 5,546,927 | 8/1996 | Lancelot | 126/200 X |

*Primary Examiner*—Larry Jones

*Attorney, Agent, or Firm*—Herbert L. Lerner; Laurence A. Greenberg

[57] ABSTRACT

An oven door of a kitchen stove includes an inner door bottom, an outer door unit having additional door elements and a front panel being formed of glass or glass-like material and forming a door front. Connecting elements act as carriers for the additional door elements. The connecting elements are secured directly or indirectly to the front panel and are connected to the door bottom through contact points of low capacity for heat exchange, for joining the front panel to the door bottom.

22 Claims, 3 Drawing Sheets

Fig. 5
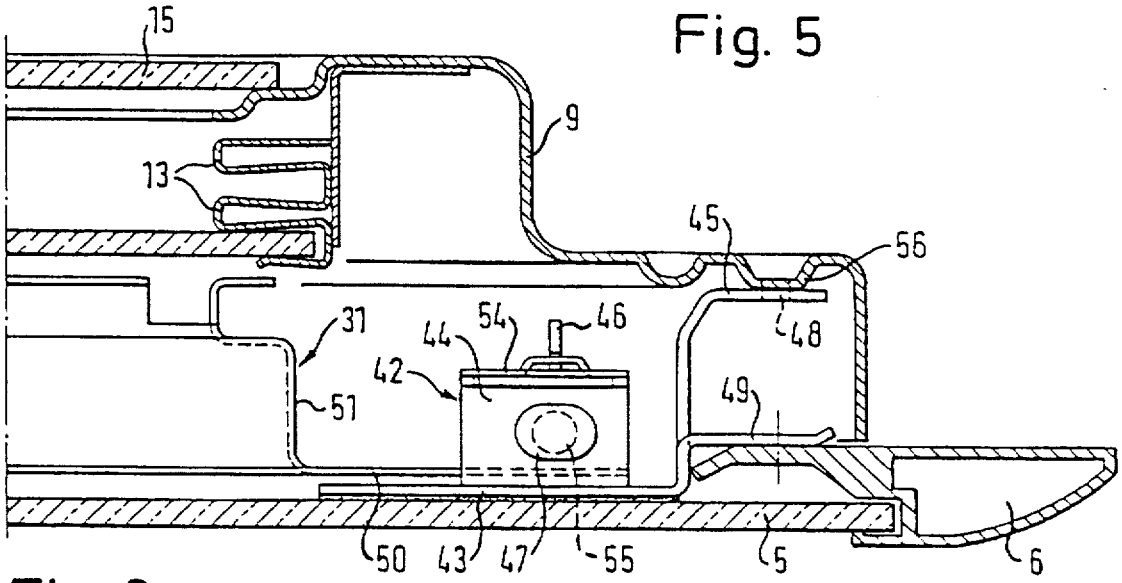
Fig. 6a
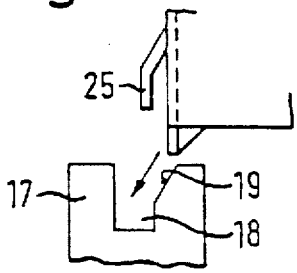
Fig. 7a
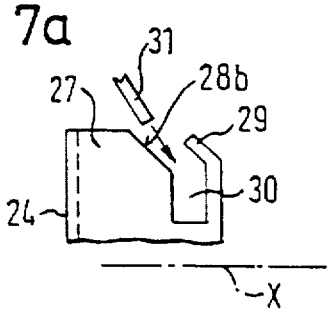
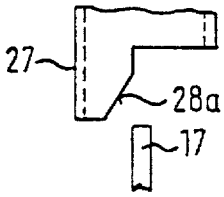
Fig. 6b
Fig. 7b
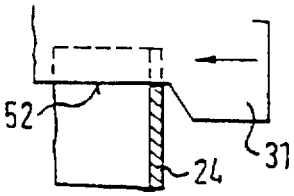
Fig. 6c
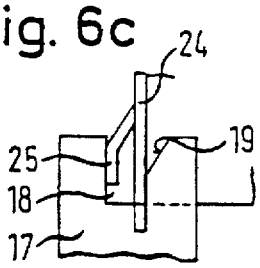
Fig. 6d
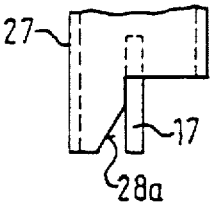
Fig. 7c
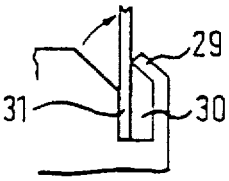

OVEN DOOR OF A KITCHEN STOVE

BACKGROUND OF THE INVENTION

1. Field of the Invention

The invention relates to an oven door of a kitchen stove, including an inner door bottom and a front panel forming a door front, the front panel is preferably formed of glass or glass-like material and is joined to the door bottom through connecting elements being secured directly or indirectly to the front panel.

In a known oven door (German Patent DE-PS 28 10 123), an external pane of glass is provided as the front panel of the oven door, while a further, internal pane of glass is disposed at an inner boundary of the bottom of the door. In order to join the door bottom to the front panel, angle rails are secured to the inside of the external pane of glass by adhesive bonding, and those rails are joined to corresponding retaining elements for the inner door bottom. In another oven door (German Patent DE-PS 32 38 441), an angle-like retaining element is again glued to the lower boundary of a front glass panel and interlocks with a lower strip of the door bottom, while on the top of the door the outer glass pane is retained in a fitting strip, which grips it and is part of the inner door bottom.

SUMMARY OF THE INVENTION

It is accordingly an object of the invention to provide an oven door for a kitchen stove, which overcomes the hereinafore-mentioned disadvantages of the heretofore-known devices of this general type and which does so in such a way that even if there are a relatively large number of door elements, the structural layout and installation, and in particular the development of product variants, are simplified, and the heat energy produced during stove operation is at least largely prevented from passing through the oven door, so that the front of the oven is cool.

With the foregoing and other objects in view there is provided, in accordance with the invention, an oven door of a kitchen stove, comprising an inner door bottom; an outer door unit having additional door elements; a front panel preferably being formed of glass or glass-like material and forming a door front; and connecting elements acting as carriers for the additional door elements, the connecting elements being secured directly or indirectly to the front panel and being connected to the door bottom through contact points of low capacity for heat exchange, for joining the front panel to the door bottom.

In accordance with another feature of the invention, there are provided mutually opposite door sides, the connecting elements, preferably in pairs, enabling a fixation of the additional door elements and a connection with the door bottom substantially through form-locking engagement and force-locking engagement in the vicinity of the door sides.

In accordance with a further feature of the invention, the door bottom has bearing grooves or bearing edges of bearing tabs, and each of the connecting elements enabling fixation by form-locking engagement has bearing edges or bearing grooves engaging the bearing grooves or bearing edges of the bearing tabs disposed on the door bottom, for connection with the door bottom.

In accordance with an added feature of the invention, each of the connecting elements enabling fixation by form-locking engagement has bearing grooves for receiving one of the additional door elements in an insertion direction, and preferably the front panel has a door viewing window, and the one additional door element is a frame encompassing the door viewing window.

In accordance with an additional feature of the invention, there are provided adjustment edges or adjustment surfaces extending obliquely to the insertion direction and joining the bearing grooves.

In accordance with yet another feature of the invention, there are provided clamping tabs disposed on the connecting element in the vicinity of the bearing groove, for mutual play-free bracing of the connecting elements and the door bottom or the additional door element.

In accordance with yet a further feature of the invention, the bearing edge and the bearing groove are disposed substantially at right angles to one another and are braced on one another over a small surface area.

In accordance with yet an added feature of the invention, there is provided a peripheral strip being disposed along and gripping a lateral edge of the front panel and having a fastening tab, the connecting element enabling fixation by form-locking engagement having a receptacle being open toward a lateral door boundary, for receiving the peripheral strip in an insertion direction and fixing the peripheral strip with the fastening tab.

In accordance with yet an additional feature of the invention, the front panel has an inner surface bounding the receptacle like a groove.

In accordance with again another feature of the invention, the receptacle has a preferably beveled edge, the front panel has a lateral boundary edge, the fastening tab of the peripheral strip has adjustment surfaces being aimed at one another and extending obliquely to the insertion direction, and the adjustment surfaces cooperating upon insertion in a centering fashion with the edge of the receptacle and with the lateral boundary edge of the front panel.

In accordance with again a further feature of the invention, the connecting element has a centering tab in the vicinity of the receptacle, the centering tab cooperating with a centering groove formed in the peripheral strip.

In accordance with again an added feature of the invention, each of the connecting elements is symmetrical and preferably T-shaped, has pairs of at least one of bearing edges and bearing grooves on both sides of an axis of symmetry for the additional door elements, and has at least one fastening tab located in the axis of symmetry.

In accordance with again an additional feature of the invention, the door bottom is tub-shaped, and there is provided a composite glass pane structure being secured in the door bottom and forming an inner door unit.

In accordance with a concomitant feature of the invention, the composite glass pane structure has at least two opposed sides with meanderingly shaped retaining rails for retaining a plurality of glass panes.

According to the invention, the connecting elements are assigned a multiple function. In addition to mechanically joining the inner and outer door units, the connecting elements serve to retain other door elements, such as a funnel-like frame that surrounds the viewing window in the door and determines its aperture, in order to retain and positionally accurately fix lateral front strips and the like within the outer door unit. Preferably, the aforementioned sets of door components are joined together in such a way that the connecting elements are joined to the front panel through an adhesive connection, which in turn reduces the heat conductivity of this mechanical connection. In general, a very low heat exchange capacity between the outer and inner door units is attained, because the contact points inside the outer door unit and with the door bottom are limited essentially to individual points of contact. Moreover, the specialized structure of the connecting elements assures that the joining of the door units and the door elements will be carried out by self-centering, so that maximum mechanization of production is attainable.

Other features which are considered as characteristic for the invention are set forth in the appended claims.

Although the invention is illustrated and described herein as embodied in an oven door for a kitchen stove, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 5 is a view similar to FIG. 3, which is taken along the line V—V of FIG. 2, in the direction of the arrows;

FIGS. 6*a* through 6*d* are fragmentary, elevational views of a connection between an outer and an inner door unit of the oven door of FIG. 2; and FIGS. 7*a* through 7*c* are fragmentary, elevational views of a connection of a door element which is constructed as a frame and is part of the outer door unit, with associated connecting elements.

DESCRIPTION OF THE PREFERRED EMBODIMENTS

Figure 1:
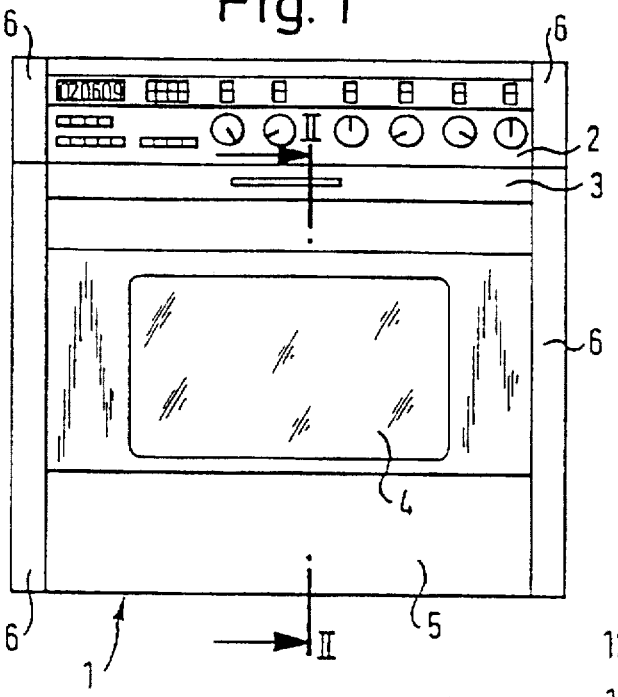
FIG. 1 is a diagrammatic, front-elevational view of a kitchen stove.
Figure 1:
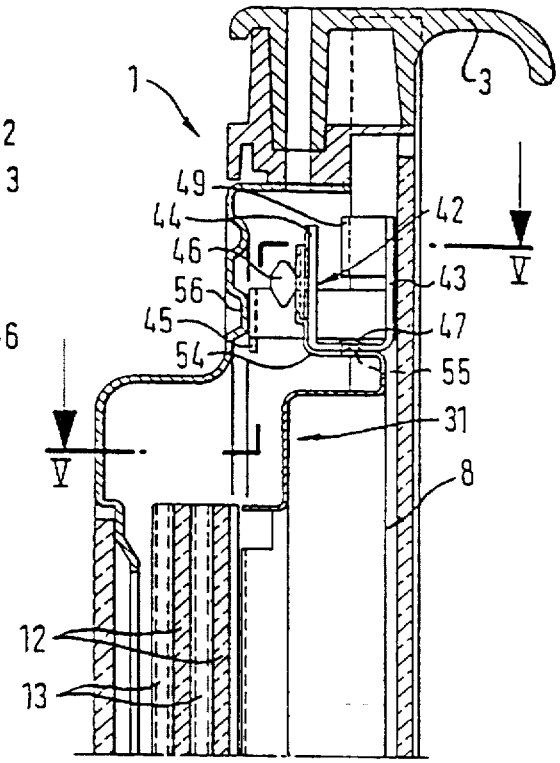

Referring now to the figures of the drawing in detail and first, particularly, to FIG. 1 thereof, there is seen a kitchen stove which is a so-called built-in stove, having an appearance at the front that is defined by a large-area oven door 1, behind which there is an oven, and by a control panel 2 that has a number of switching and display elements and is located above the oven door 1. The oven door is provided with a handle 3 at the top and a viewing window 4 in the center. The viewing window 4 is formed at the front by a transparent, rectangular piece of a continuous front panel 5 that is formed of glass or glass-like material in the exemplary embodiment. Both the control panel and the oven door are defined on both sides by vertical peripheral strips 6, which are detachably joined to the oven door 1 and the control panel 2. The oven door 1 may be equipped as a so-called folding door, with a hinge at the bottom, or as an oven door that can be pulled out like a drawer, or the like.

Figure 2:
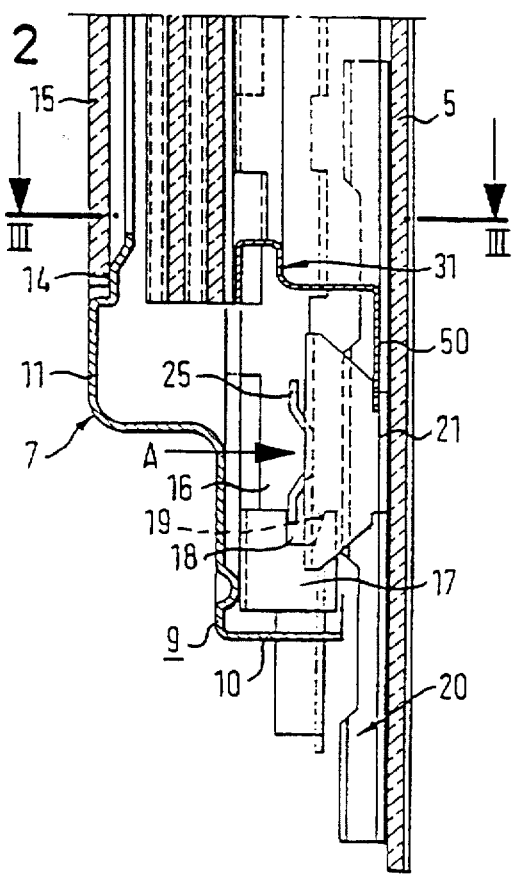
FIG. 2 is an enlarged, longitudinal-sectional view of the oven door of the kitchen stove, which is taken along the line II—II of FIG. 1, in the direction of the arrows.

The oven door 1 shown in section in FIG. 2 substantially includes two door units, namely an inner door unit 7 and an outer door unit 8. The inner door unit 7 that faces toward the oven space has a load-bearing portion in the form of a metal door bottom 9, which has a tub-like part 10 and a likewise rectangular part 11 of smaller circumference, that protrudes toward the oven space in the exemplary embodiment. As will be described in further detail below, a composite structure 12 of panes of glass with retaining rails 13 is disposed in the aforementioned door bottom part 11, and this inner door bottom part 11 has a likewise rectangular window cutout 14, in which an innermost pane of glass 15, or in the case where a microwave apparatus is present in the kitchen stove, a metal grating or a perforated plate, is disposed and secured. Secured to both sides of the door bottom part 10, for instance by welding, are vertical, multiply profiled rails 16, which in a lower region have flat, substantially plate-like bearing tabs 17 that are bent at an angle in the direction of the outer door unit 8. These bearing tabs, which are disposed in the region of the lateral boundaries of the door bottom 9 and thus of the oven door 1, have upward-oriented bearing grooves 18, as are shown in FIGS. 6*a* and 6*b*, with obliquely extending adjustment edges 19.

Figure 3:
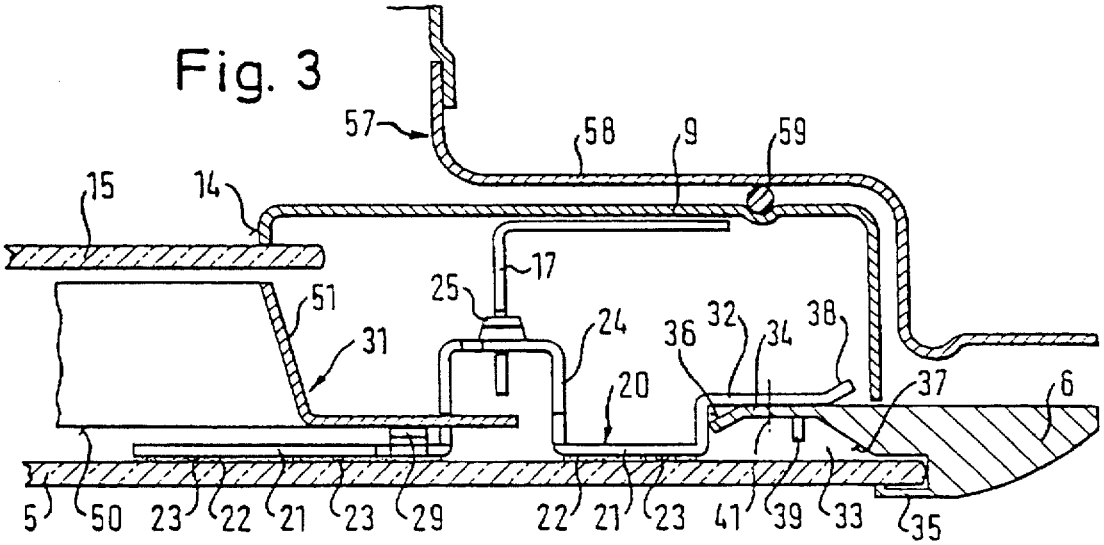
FIG. 3 is a simplified, further enlarged, cross-sectional view of a portion of the oven door, which is taken along the line III—III of FIG. 2, in the direction of the arrows.
Figure 4:
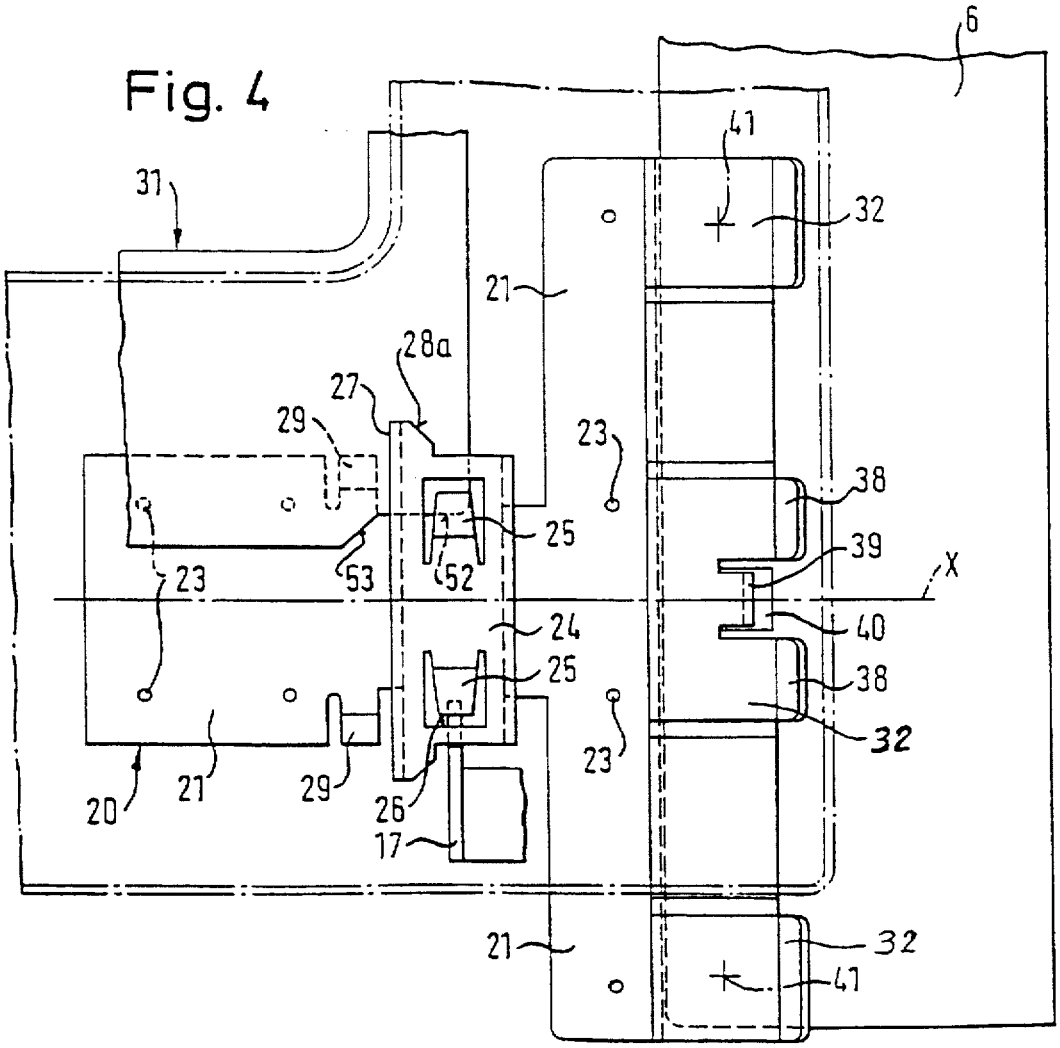
FIG. 4 is a fragmentary, elevational view of a region of the oven door of FIG. 3, which is taken in the direction of an arrow A in FIG. 2.

As its outermost boundary, the outer door unit 8 has a front panel 5 that extends over practically the entire surface of the door. In FIG. 3, this front panel 5 is shown as a single sheet. Studying FIG. 2 and FIGS. 3 and 4 together shows that in the lower region and on both sides of the front panel 5, metal connecting elements 20, which are to be described in further detail below and which for reasons of thermal expansion are, for instance, formed of elastically resilient spring material, are secured to fastening tabs 21 by an adhesive material 22 on the inside of the front panel 5 by adhesion. These fastening tabs 21 have embossed bumps 23, through the use of which a gap to permit correct adhesive bonding is obtained between the aforementioned fastening tabs 21 and the front panel 5. Each connecting element 20 is constructed essentially in the shape of a T and has the aforementioned fastening tabs 21, which are located in the same plane and are disposed in the region of an axis of symmetry X. Disposed between the two fastening tabs 21 is a bridge-like protrusion 24, forming a fastening tab which, on the bottom of the protrusion on both sides of the axis of symmetry X, has bearing tabs 25 that are cut free in pairs, with bearing edges 26, and additionally on both sides of the axis of symmetry X on elongated tabs 27 has adjustment edges 28*a* and 28*b* (seen in FIGS. 6*a* through 6*d*). In the direction of the axis of symmetry X, following the protrusion 24, fastening tabs 29 which are bent upward are also provided on both sides of the axis of symmetry X on the connecting element 20. The function of the fastening tabs 29 will be described below. FIG. 7*a* shows the protrusion 24 in a side view. In the region of transition points to the fastening tabs 21, the protrusion 24 has bearing grooves 30, preferably in both legs of the protrusion 24, which merge with the oblique adjustment edges 28*b* at the level of which the support tabs 29 are located. The insertion of a flat door element, for instance a frame 31 to be described below, into the bearing groove 30 in the direction of the arrow, is facilitated by the adjustment edges 28*b*.

FIG. 7*b* shows the configuration in a plan view, with the frame 31 inserted into the bearing groove or grooves 30. When the frame 31 is pivoted or moved upright as is shown in FIG. 7*c*, the adjacent frame portion is braced against the support tab 29 and is pressed by lever action against an edge of the bearing groove 30. It can also be seen from FIGS. 3 and 4 that the connecting element 30 adjacent the inner fastening tab 21 has receptacles 32, which are bent upward in an L on the T-shaped legs of the fastening tabs 21, and in conjunction with the inner surface of the front panel 5 these receptacles form receiving grooves 33. A fastening tab 34 of the peripheral strip 6 mentioned above can be inserted into these receiving grooves 33. This peripheral strip 6 which, for instance, is formed of aluminum material, has a vaulted profile on its front and a longitudinal groove 35, which is engaged by the vertical boundary edge of the front panel 5.

The fastening tab 34 has adjustment surfaces 36 and 37, extending obliquely to the direction of insertion of the peripheral strip (in the direction of the arrow) and being aimed at one another, which cooperate in a centering fashion with the likewise beveled edge 38 of the receptacles 32 and with the lateral boundary edge of the front panel 5 when the peripheral strip 6 is inserted. The connecting element 20 has a centering tab 39, in the region of the middle receptacle 32, that cooperates with a centering groove 40 of the peripheral strip 6 in such a way that a positionally accurate fixation of the peripheral strip 6 relative to the oven door is attained. Provision is made so that a screw connection between the receptacles 32 and the fastening tab 34 is present at locations or points 41.

It can be seen from FIGS. 2 and 5 that in a way similar to the lower region of the oven door 1, connecting elements 42 are provided in the upper region on the inside of the front panel 5 as well. These elements 42 are glued directly to the inside of the front panel 5 with fastening tabs 43. Each connecting element 42 has a bracket 44 which is bent approximately in a U, and a substantially L-shaped fastening tab 45. The fastening tab 45 protrudes beyond the bracket 44. In the freely protruding leg of the bracket 44, an approximately diamond-shaped offset tab 46 is constructed in the form of a free cut, and it is rotatable, for instance by 90°, in order to fix a door element to be described below. The leg of the bracket 44 that does not protrude freely has a substantially circular detent indentation 47, while the fastening tab 45 is provided with a fastening opening 48, for instance in the form of an oblong slot. Finally, another component of the connecting element 42 is a receptacle 49, which is constructed similar to the receptacle 32 of the connecting element 20, but without a centering tab and instead with a beveled edge. In the exemplary embodiment, the upper end of the peripheral strip 6, which as FIG. 5 shows is constructed essentially as a hollow body, can be inserted into this receptacle 49. In contrast to the upper connecting elements 42, the lower connecting elements 20 are symmetrical in shape, so that they can be secured to both sides of the front panel 5 in a mirror-symmetrical configuration.

A door element, namely the frame 31 which is associated with the outer door unit 8, is secured to the connecting elements 20 and 42, which are each provided in pairs. This frame has a flat base 50 and a flange 51 extending all the way around it, except for the corner regions, in stairstep or oblique fashion toward the inner door unit 7. This flange forms or defines the aperture of the window in the oven door 1. In the pre-assembly of the outer door unit 8, the frame 31 is installed in the manner shown in FIGS. 7*a* to 7*c* in the bearing grooves 30 of the connecting element 20 with cut-out bearing edges 52 that are present on both sides of the lower frame boundary. Centering edges 53 that extend obliquely make for easier assembly with accurate positioning. Once the frame 31 has been inserted obliquely into the bearing grooves 30, the frame 31 is pressed into the vertical position as already explained, whereupon the base 50 of the frame 31 is thus braced against the associated support tabs 29 and fixed so that it cannot be jarred out of place. On its upper end, the frame has L-shaped tabs 54, each with a detent protrusion 55 in the form of a portion of a sphere and with an oblong-slot-like fastening opening. After the frame has been installed in the lower connecting elements 20, this frame 31 is pressed in the direction of the upper connecting elements 42, causing the detent protrusions 55 to interlock with the detent indentations 47 of the connecting element 42, and the aforementioned fastening opening, in the form of an oblong slot, grips the offset tabs 46 from behind, whereupon these offset tabs are twisted and the frame 31 is thus fixed.

Joining the inner door unit 7 to the outer door unit 8 is then accomplished by inserting the outer door unit 8 with the bearing tabs 25 of the lower connecting elements 20 into the bearing grooves 18 of the bearing tabs 17 of the door bottom 9, in the manner described in conjunction with FIGS. 6*a* through 6*d* and fixing it in such a way that it cannot be jarred out of place. As FIG. 6*c* especially shows, the largely elastic bearing tabs 25, which are torn out of the sheet-metal material of the connecting element 20, are braced largely elastically against a boundary edge of the respective bearing groove 18, while the inner surface of the U-shaped protrusion 24 is braced against the opposite groove edge. The bearing parts of the inner and outer door units 7, 8 stand edge to edge, and because there is contact over only a small surface area, this connecting point has only a slight capacity for heat exchange. In the upper portion, a force-locking connection of the two door units is effected through the use of the fastening tabs 45 of the upper connecting elements 42 and crimped tabs 56 of the door bottom 9 through the use of screws or other connecting devices, as is seen in FIG. 5. A force-locking connection is one which connects two elements together by force external to the elements, as opposed to a form-locking connection which is provided by the shapes of the elements themselves.

For the sake of completeness, in the view of FIG. 3, a peripheral portion of an oven box 57 disposed behind the oven door 1 can also be seen, as having a flange 58 on which the oven door 1 can be set with the door bottom 9 and with the interposition of a seal 59 when the oven door is closed. An inner glass pane 15 is retained in the window cutout 14 of the door bottom 9. While in the exemplary embodiment of FIG. 3 the door bottom is nearly constructed in tub-like fashion, in the exemplary embodiment of FIG. 5 the door bottom includes two stairstep-recessed door bottom parts 10 and 11, as was already explained. The aforementioned retaining rails 13 for inner panes of glass are disposed in the innermost door bottom part 11 in that case.

I claim:

1. An oven door of a kitchen stove, comprising:

an inner door bottom;

an outer door unit having additional door elements;

a front panel forming a door front;

connecting elements acting as carriers for said additional door elements, said connecting elements being secured to said front panel and being connected to said door bottom through contact points of low capacity for heat exchange, for joining said front panel to said door bottom; and mutually opposite door sides, said connecting elements enabling a fixation of said additional door elements and a connection with said door bottom substantially through form-locking engagement and force-locking engagement in the vicinity of said mutually opposite door sides.

2. The oven door according to claim 1, wherein said front panel is formed of glass or glass-like material.

3. The oven door according to claim 1, wherein said connecting elements are secured directly to said front panel.

4. The oven door according to claim 1, wherein said connecting elements are secured indirectly to said front panel.

5. The oven door according to claim 1, wherein said connecting elements are disposed in pairs.

6. The oven door according to claim 1, wherein said door bottom has bearing grooves or bearing edges of bearing tabs, and each of said connecting elements enabling fixation by form-locking engagement has bearing edges or bearing grooves engaging said bearing grooves or bearing edges of said bearing tabs disposed on said door bottom, for connection with said door bottom.

7. The oven door according to claim 6, including adjustment edges or adjustment surfaces extending obliquely to the insertion direction and joining at least one of said bearing edges and bearing grooves.

8. The oven door according to claim 6, including clamping tabs disposed on said connecting element in the vicinity of at least one of said bearing edge and bearing groove, for mutual play-free bracing of said connecting elements and said door bottom or said additional door element.

9. The oven door according to claim 6, wherein said bearing edge and said bearing groove are disposed substantially at right angles to one another and are braced on one another over a small surface area.

10. The oven door according to claim 1, wherein each of said connecting elements enabling fixation by form-locking engagement has bearing grooves for receiving one of said additional door elements in an insertion direction.

11. The oven door according to claim 10, wherein said front panel has a door viewing window, and said one additional door element is a frame encompassing said door viewing window.

12. The oven door according to claim 10, including adjustment edges or adjustment surfaces extending obliquely to the insertion direction and joining said bearing grooves.

13. The oven door according to claim 10, including clamping tabs disposed on said connecting element in the vicinity of said bearing groove, for mutual play-free bracing of said connecting elements and said door bottom or said additional door element.

14. The oven door according to claim 1, including a peripheral strip being disposed along and gripping a lateral edge of said front panel and having a fastening tab, said connecting element enabling fixation by form-locking engagement having a receptacle being open toward a lateral door boundary, for receiving said peripheral strip in an insertion direction and fixing said peripheral strip with said fastening tab.

15. The oven door according to claim 14, wherein said front panel has an inner surface bounding said receptacle like a groove.

16. The oven door according to claim 15, wherein said receptacle has an edge, said front panel has a lateral boundary edge, said fastening tab of said peripheral strip has adjustment surfaces being aimed at one another and extending obliquely to the insertion direction, and said adjustment surfaces cooperating upon insertion in a centering fashion with said edge of said receptacle and with said lateral boundary edge of said front panel.

17. The oven door according to claim 16, wherein said edge of said receptacle is beveled.

18. The oven door according to claim 14, wherein said connecting element has a centering tab in the vicinity of said receptacle, said centering tab cooperating with a centering groove formed in said peripheral strip.

19. The oven door according to claim 1, wherein each of said connecting elements is symmetrical, has pairs of at least one of bearing edges and bearing grooves on both sides of an axis of symmetry for said additional door elements, and has at least one fastening tab located in the axis of symmetry.

20. The oven door according to claim 19, wherein said connecting elements are T-shaped.

21. The oven door according to claim 1, wherein said door bottom is tub-shaped, and including a composite glass pane structure being secured in said door bottom and forming an inner door unit.

22. The oven door according to claim 21, wherein said composite glass pane structure has at least two opposed sides with meanderingly shaped retaining rails for retaining a plurality of glass panes.

* * * * *